US005906197A

United States Patent [19]

French et al.

[11] Patent Number: 5,906,197

[45] Date of Patent: May 25, 1999

[54] GAS FIREPLACE

[75] Inventors: J. Timothy French, Yorba Linda; John R. Kelly, Huntington Beach; John M. Simonen, Phillips Ranch; Samir E. Barudi, Huntington Beach, all of Calif.

[73] Assignee: Superior Fireplace Company, Fullerton, Calif.

[21] Appl. No.: 08/749,959

[22] Filed: Nov. 18, 1996

[51] Int. Cl.[6] ..... F24C 3/00

[52] U.S. Cl. ..... 126/512; 126/92 R; 126/92 AC; 126/531; 126/528; 431/125

[58] Field of Search ..... 126/512, 92 R, 126/92 AC, 92 B, 524, 525, 528, 529, 531; 431/125, 126

[56] References Cited

U.S. PATENT DOCUMENTS

| | | | |
|---|---|---|---|
| 1,884,746 | 10/1932 | Kline | 126/92 AC |
| 4,015,581 | 4/1977 | Martenson | 126/531 |
| 4,230,092 | 10/1980 | Henriques | 126/527 |
| 4,254,756 | 3/1981 | Wells | 126/531 |
| 4,519,376 | 5/1985 | Schoeff | 126/521 |
| 4,793,322 | 12/1988 | Broadbent | 126/512 |
| 5,054,468 | 10/1991 | Moon et al. | 126/531 |
| 5,218,953 | 6/1993 | Shimek et al. | 126/512 |
| 5,469,838 | 11/1995 | Broadbent | 126/512 |
| 5,479,915 | 1/1996 | Riener | 126/512 |

FOREIGN PATENT DOCUMENTS

WO 92/17739 10/1992 WIPO .

*Primary Examiner*—James C. Yeung
*Attorney, Agent, or Firm*—Christie, Parker & Hale, LLP

[57] ABSTRACT

A vent free gas fireplace comprises a housing and a firebox within the housing spaced-apart from the housing walls to provide top, bottom, rear and side plenums. The side plenums are divided into upper and lower side plenums. Room air enters the lower side plenum and passes into the rear plenum, the combustion chamber and the upper side plenum. Exhaust gases pass from the combustion chamber through a catalytic converter and into the top plenum. The hot exhaust gases are combined with room air from the rear plenum and pass into the upper side plenums, combining with additional room air, and then out into the room.

46 Claims, 9 Drawing Sheets

GAS FIREPLACE

FIELD OF THE INVENTION

This invention relates to factory built gas fireplaces comprising one or more glass panels, and more particularly to a vent free gas fireplace construction with increased height of the glass panels.

BACKGROUND OF THE INVENTION

Traditional masonry wood burning fireplaces comprise a large masonry firebox and a masonry chimney which extends upwardly above the roof of a house to vent the combustion gasses formed when the wood burning fireplace is used. These fireplaces have been and continue to be very popular. Unfortunately, they suffer from a number of drawbacks. For example, such fireplaces are fixed in place and require the room to be built and decorated around the fireplace. Because their heating efficiency is also very low, they do not make very good room heaters. Moreover, they need to be cleaned continuously due to ash accumulation.

Factory built gas fireplaces on the other hand overcome many of the drawbacks suffered by the traditional masonry fireplaces. Depending on the design, gas fireplaces can be highly efficient and hence good room heaters. They may be free standing units which can be located anywhere in a room, zero clearance units designed to abut a wall or fireplace inserts which fit into existing masonry fireboxes. As used herein "factory built gas fireplaces" is meant to include free-standing gas fireplaces, zero clearance gas fireplaces and gas fireplace inserts using natural, propane or butane gas.

Most gas fireplaces require venting, generally from the top or rear of the fireplace. For example, rear direct vent fireplaces comprise an intake air vent and an exhaust vent which extend rearwardly through an exterior wall of the room in which the unit is located.

Gas fireplaces typically comprise room air plenums below, adjacent the sides and/or rear and above the firebox. A convection current is created whereby room air is pulled into the bottom plenum, passes upwardly in the side and/or rear plenums into the top plenum and thereafter exits the fireplace from the top plenum. As the room air circulates around the firebox, heat is transferred from the firebox to the circulating room air so that the temperature of the air exiting the top plenum, is substantially increased.

In a direct vent gas fireplace, combustion air from outside the house or building is delivered to the combustion chamber typically through an intake vent and an intake plenum which extends behind the firebox and, in some cases, below the firebox. Combustion air from the intake plenum passes into the combustion chamber through one or more openings in the bottom wall or at the bottom of the rear wall or side walls of the firebox.

In vented gas fireplaces, exhaust gas is typically passed from the combustion chamber directly into an exhaust vent. To maximize heating efficiency, some gas fireplaces employ one or more baffles within the combustion chamber to increase the residence time of the hot gasses within the combustion chamber thereby maximizing heat transfer through the glass front and through the firebox walls to room air circulating around the firebox.

Vent free units, in which exhaust gasses are vented directly into the room are also known. In such fireplaces, the combustion gasses are tightly controlled to prevent formation of excessive amounts of carbon monoxide and undesirable hydrocarbons. Such tight controls require a clean burning flame. This makes it difficult to simulate the aesthetically pleasing, but relatively dirty yellow flames of wood burning fireplaces in a ventless fireplace.

SUMMARY OF THE INVENTION

The present invention provides a new construction for a factory built gas fireplace, preferably a vent free or direct vent fireplace. A preferred fireplace comprises a housing having top, bottom, front, rear and side walls. At least the front wall has a glass panel. A firebox having top, bottom, rear and side panels is located within the housing. The glass panel of the front wall of the housing in combination with the firebox forms a combustion chamber.

A side plenum is provided between each side panel of the firebox and the adjacent side wall of the housing. Each side plenum comprises upper and lower portions, each of which has an opening at its front end to allow room air to pass into the lower portion and out of the upper portion of the side plenum. The openings may be separate or may form a single continuous opening. In this arrangement, during operation, cool air from the room in which the fireplace is situated enters the lower portion of the side plenum, passes into the upper portion of the side plenum acquiring heat from the firebox, and then exits the upper portion of the side plenum back into the room as warm air.

Preferably, means are provided for dividing each side plenum into discreet upper and lower side plenums, each of which has an opening at its front end to allow room air to pass into and out of the lower and upper side plenums respectfully. Means are also provided for enabling air from the lower side plenum to pass into the upper side plenum above it. In one embodiment, the dividing means comprises a generally horizontal panel which extends across the side plenum, dividing it into upper and lower side plenums. In such an embodiment, the preferred means for enabling air from the lower side plenum to pass into the upper side plenum comprises one or more openings in the generally horizontal divider. Another preferred means for enabling air to pass from the lower side plenum into the upper side plenum comprises a rear plenum located between the rear panel of the firebox and the rear wall of the housing, wherein the rear plenum is in communication with the lower and upper side plenums. In this embodiment, air flows from the room into the lower side plenum, passes into the rear plenum, then into the upper side plenum and back out into the room.

In a preferred embodiment of the invention, there is provided a factory built vent free fireplace comprising a housing having top, bottom, front, rear and side walls. At least the front wall comprises a glass panel. A firebox having top, bottom, rear and side panels is located within the housing and, in combination with the glass panel, forms a combustion chamber. The fireplace comprises upper and lower side plenums which are open at their front to enable air from the room which the fireplace is situated to pass into and out of the lower and upper side plenums. Means are provided for enabling air in the lower side plenum to pass into the upper side plenum. Means are also provided for allowing air to pass from the lower side plenum into the combustion chamber.

Preferably, the vent free gas fireplace further comprises a top plenum between the top panel of the firebox and the top wall of the housing. The top plenum is in communication with each upper side plenum. An opening is provided in the top panel of the firebox. In such an arrangement, hot gasses from the combustion chamber pass through the opening into the top plenum and then flow laterally to the upper side plenums and out the fireplace. Preferably, a catalytic converter is provided and situated, preferably in the opening in the top panel of the firebox, so that carbon monoxide and undesirable hydrocarbons in the hot gasses exiting the combustion chamber will further react with the catalyst of the catalytic converter to form carbon dioxide and water vapor.

The present invention further comprises a unique front glass panel and vent door assembly wherein vent doors are provided on each lateral side of the glass panel directly in front of the side plenums and are movable between closed and open positions. Preferred vent doors are louver doors having a plurality of generally vertical, spaced apart slats.

Another aspect of the invention provides a factory built gas fireplace having a height of preferably not more than about 60 inches and preferably not more than about 48 inches and even more preferably a height of not more than about 40 inches, in which the height of the viewing area extends over about 80%, preferably over about 85%, more preferably over about 90% of the height of the fireplace. Such a viewing area creates a distinct and attractive fireplace. Moreover, by increasing the height and therefore surface area of the glass panel to provide such a viewing area, an increase in radiant heating through the glass panel is achieved.

BRIEF DESCRIPTION OF THE DRAWINGS

The foregoing features of the invention will be better understood upon consideration of the following detailed description of certain preferred embodiments taken in conjunction with the accompanying drawings wherein.

DETAILED DESCRIPTION

Figure 1:
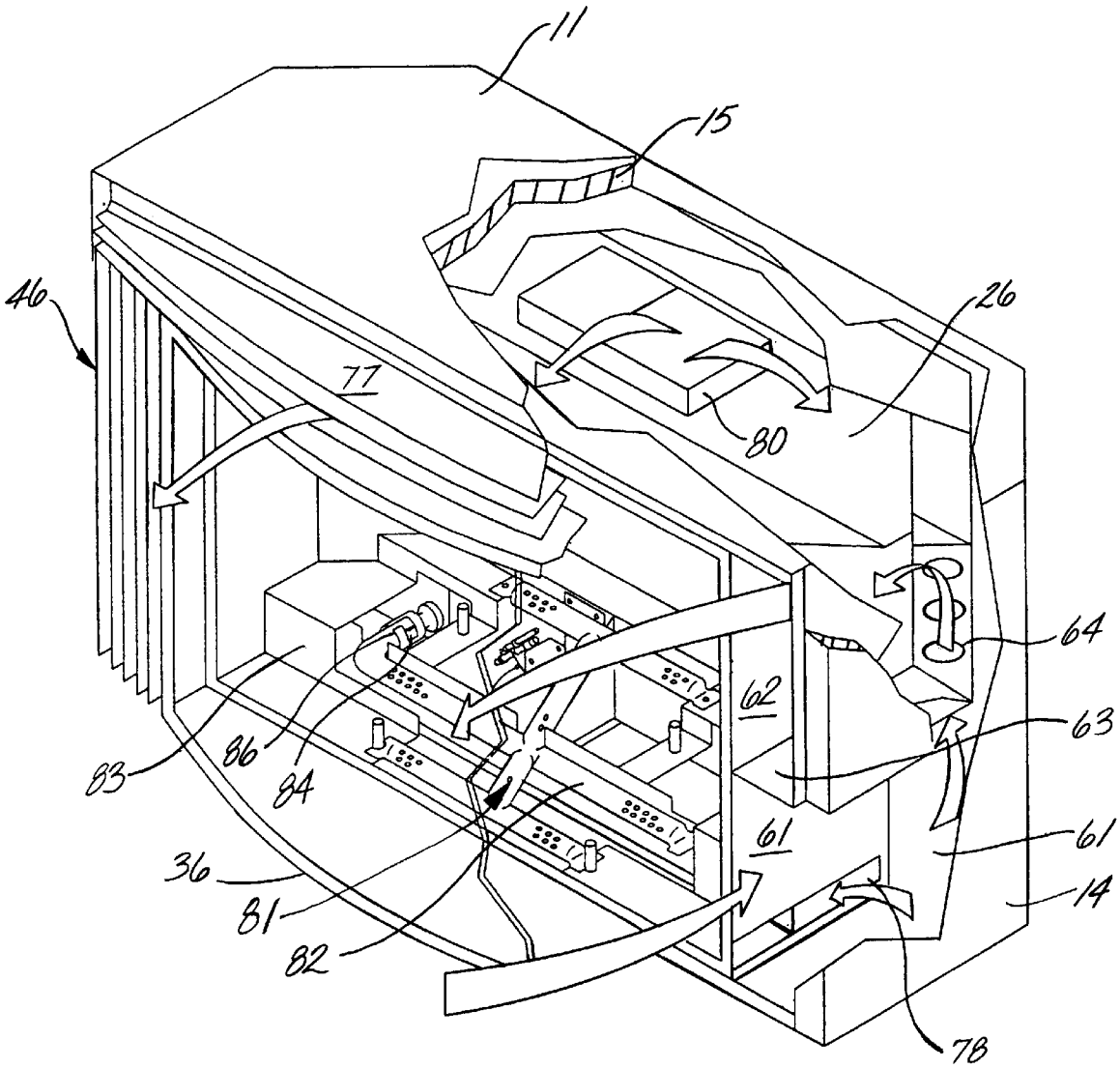
FIG. 1 is a perspective cut-away view of a preferred fireplace constructed in accordance with the present invention.
Figure 2:
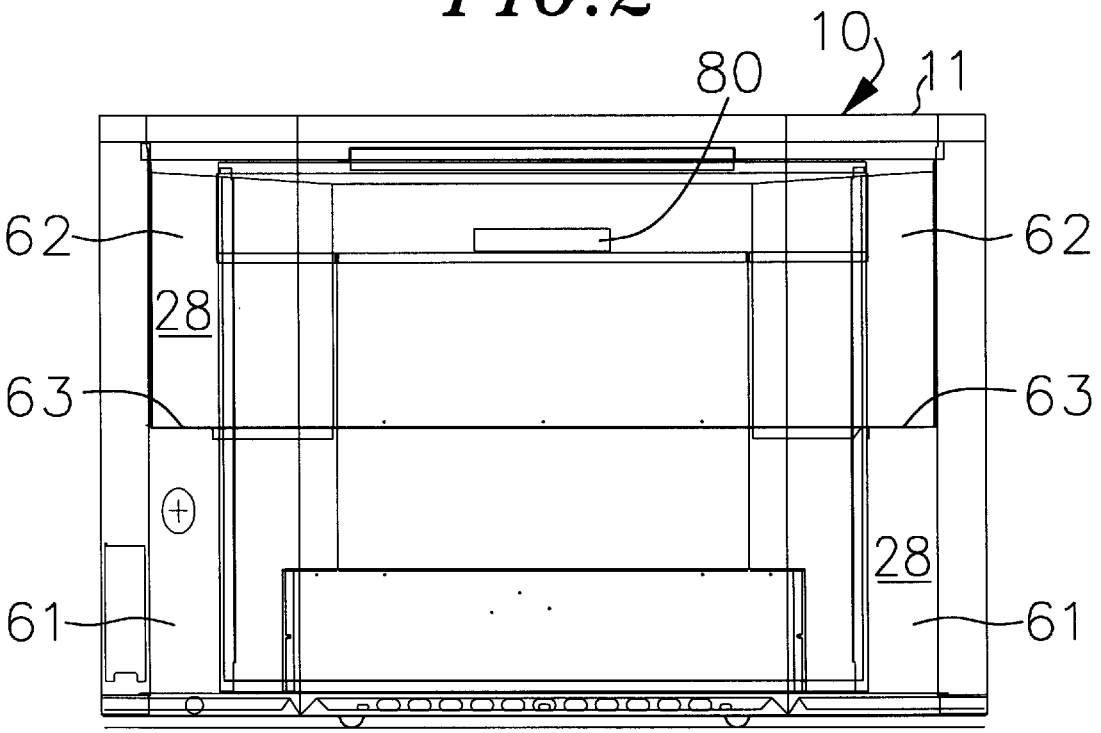
FIG. 2 is a front view of the fireplace of FIG. 1.
Figure 3:
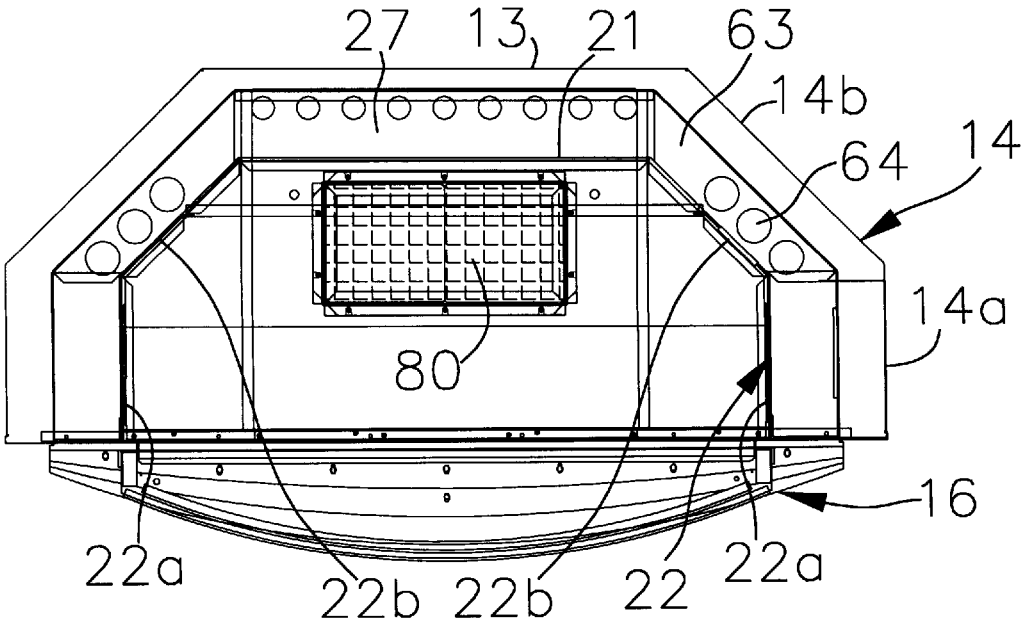
FIG. 3 is a horizontal cross-sectional view of the fireplace of FIG. 1.

A particularly preferred gas fireplace made in accordance with the present invention as shown at FIGS. 1–4. The fireplace includes an outer housing 10 comprising a top wall 11, bottom wall 12, rear wall 13 and a pair of side walls 14, each side wall comprising a front section 14*a* and a rear section 14*b* which extends rearwardly and inwardly from the front portion 14*a* to the rear wall 13. At the front of the housing 10, there is provided a glass panel and louver door assembly 16.

The top wall 11 and about the upper half of the rear wall 13 and side walls 14 of the housing 10 comprise a layer of insulation 15, e.g. one inch fiberglass. The insulation reduces the heat transfer through the walls and minimizes the temperature of those exterior surfaces of the fireplace adjacent the insulation 15.

A firebox 17 is located within the housing 10. The firebox 17 comprises a top panel 18, a bottom panel 19, a rear panel 21 and two side panels. 22 Each side panel 22 comprises a front portion 22*a* and a rear portion 22*b* which extends rearwardly and inwardly to the rear panel 21. The top panel 18 of the firebox 17 comprises a generally horizontal rear portion 18*a* and a front portion 18*b* which extends forwardly and upwardly from the rear portion 18*a* toward the forward edge of the top panel 11 of the housing 10. The top panel 18, rear panel 21 and side panels 22 of the firebox 17 are spaced apart from the respective top wall 11, rear wall 13 and side walls 14 of the outer housing 10 thereby forming a top plenum 26 between the top panel 18 of the firebox 17 and the top wall 11 of the housing 10, a rear plenum 27 between the rear panel 21 of the firebox 17 and the rear wall 13 of the housing 10, two side plenums 28 between the side panels 22 of the firebox 17 and the side walls 14 of the housing 10. In the embodiment shown, there is also a bottom plenum 29 between the bottom panel 19 of the firebox 17 and the bottom wall 12 of the housing which is open at its low end. If desired, the bottom plenum 29 may be eliminated and replaced with a bottom wall 12 having a layer of insulation 15. The top plenum 26 and side plenums 28 are open at their forward ends.

The front glass panel and door assembly 16 comprises a glass panel assembly 31 which, in combination with the firebox 17 forms a combustion chamber 30. In the embodiment shown, the glass panel assembly 31 comprises non-planer, outwardly curved glass panel 32. Other preferred glass panels are planer glass panels i.e., a single flat panel and non-planer glass panels e.g., having two and preferably three or more, flat sections. It is understood that the glass panel may have any other desired shape.

Figure 7:
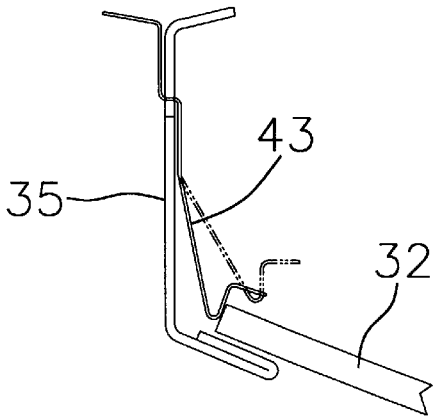
FIG. 7 is a top view of a preferred spring clip.
Figure 8:
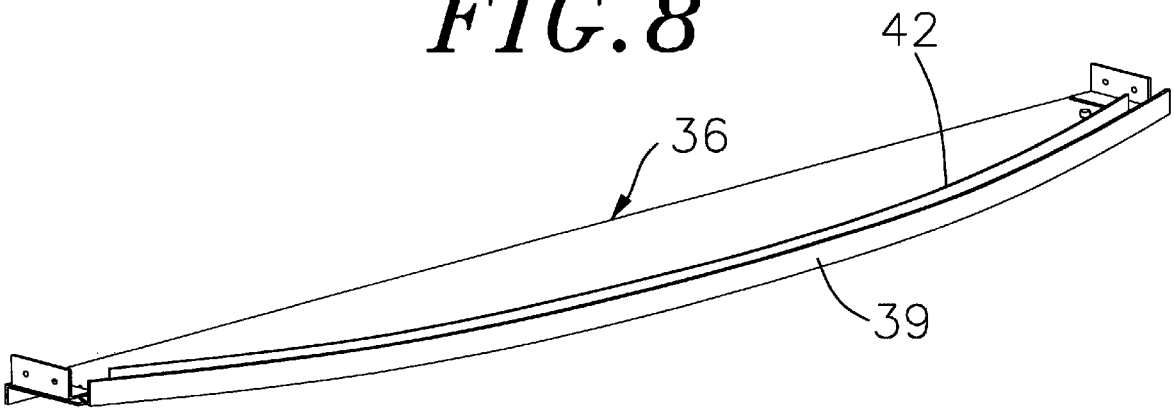
FIG. 8 is a perspective view of a preferred bottom frame member.

With reference to FIGS. 5–8, the glass panel 32 of the glass panel assembly is mounted in a frame 33 having a top member 34, two side members 35 and a bottom member 36. The top frame member 34 has a downwardly depending flange 37 along its forward edge. The side members 34 of an inwardly extending flange 38 along their forward edge. The bottom member 35 has an upwardly extending flange 39 along its forward edge. The glass panel 32 has a gasket 40 which is applied to and adheres over the top edge and both side edges of the glass panel 32 except for about the bottom two inches of the side edges. The glass panel 32 is mounted in the frame 33 behind the front flanges of the top member 34, side member 35 and bottom member 36 by spring clips 43 (FIG. 7).

The bottom edge of the glass panel 32 extends into a channel 41 formed between the front flange 39 of the bottom member 36 and an inner flange 42 spaced apart rearwardly from the front flange 39 of the bottom member 36. The bottom edge of the glass panel 32 is generally spaced apart from the surfaces of the channel 41. This allows room air to flow through the gap between the bottom edge of the glass panel 32 and the channel 41 surfaces and into the combustion chamber to cool the inner surface of the glass panel 32 and to aid in combustion.

Figure 9:
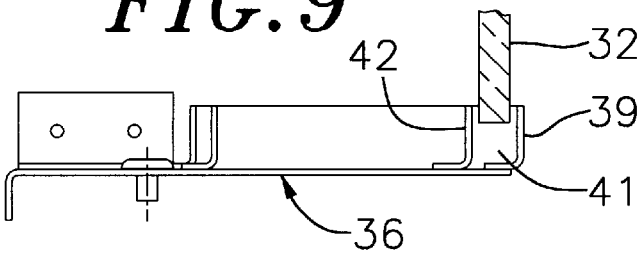
FIG. 9 is a cross-sectional view of the bottom frame member of FIG. 8.
Figure 10:
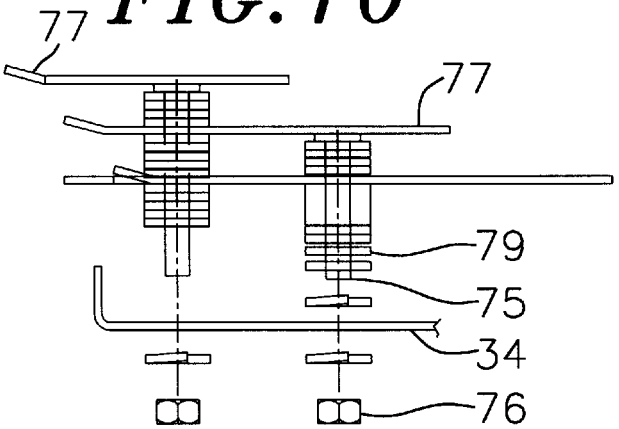
FIG. 10 is a side view showing a preferred means for mounting the heat dissipating fins to the top frame member.

A louver door 46 is hingedly mounted adjacent to each of the side frame members 35 directly in front of the side plenums 28. The louver door 46 comprises upper and lower hinges 47 and 48. As shown in FIGS. 9 and 10, the upper hinge 47 has a generally flat section 49 which extends over the surface of the top frame member 33. A hole 51 is provided in the flat section 49 which receives a hinge post 52 (FIG. 5) which extends upwardly from the top frame member 33. The lower hinge 48 also has a flat section 49 which extends under the bottom frame member 36. A hole 51 is provided in the flat section 49 which receives a hinge post (not shown) which extends downwardly from the bottom frame member 36 in a manner similar to that of the upper hinge 47.

Figure 11:
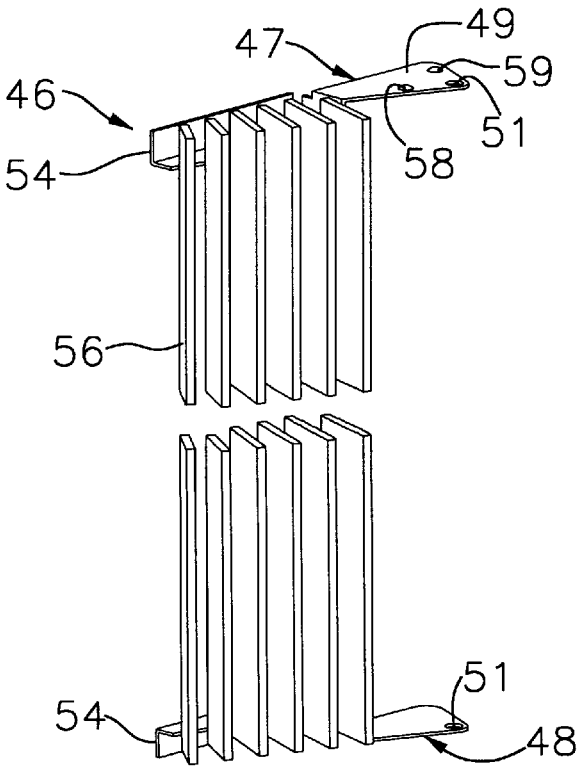
FIG. 11 is a perspective view of a preferred louver door.
Figure 12:
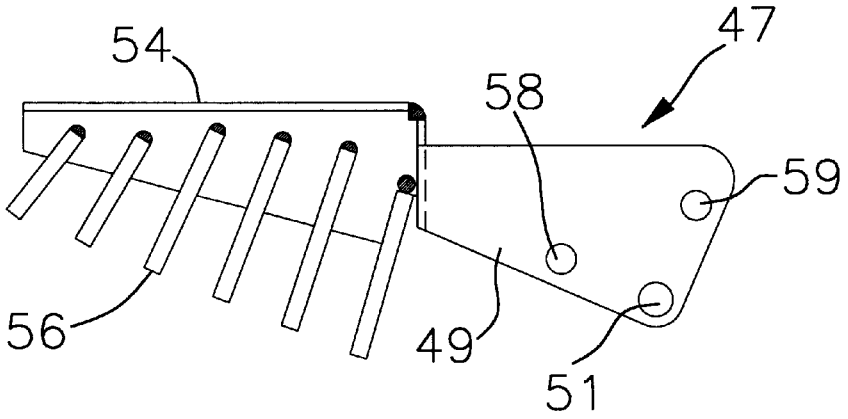
FIG. 12 is a top view of a preferred hinge bracket.

Each of the upper and lower hinges 47 and 48 also comprises an L-shaped bracket portion 54 to which a plurality of generally vertical extending louver bars 56 are fixedly attached. As shown in FIG. 11, the edges of the louver bars 56 extend into notches in the lower horizontal section of the bracket portion 54. In this arrangement, the louver bars 56 are spaced apart from adjacent bars to provide openings into the side plenums 28.

The louver doors 46 are movable between open and closed positions. In the closed position, the bracket portions 54 abut the front edges of the housing top panel 11. To releasably secure each louver doors 46 in its open and closed positions, there is provided a pin 57 (FIG. 5) having a rounded head which is mounted on the top frame member 34 spaced apart from the hinge post 52 toward the louver bars 56. The flat section 49 of each upper hinge 47 comprises a pair of indentations 58 and 59 positioned so that the head of the pin seats in indentation 58 when the door 46 is in its closed position and seats in the other indentation 59 when the door 46 is in its opened position. The size of the head of the pin 57 is selected to allow the flat section 49 of the upper hinge 47 to ride over the pin 57 as the louver door 46 is opened and closed.

While it is presently preferred that the bars 56 of the louver doors be fixed, it is understood that they may be hingedly movable, preferably in unison so as to direct the flow of hot air from the fireplace as desired. It is also to be understood that the style of door as well as the type of hinge or other opening and closing mechanism may vary as desired as is well known in the art.

Again with reference to FIGS. 1–3, the side plenums are divided into a lower side plenum 61 and an upper side plenum 62 by a generally horizontal divider 63. Both the lower side plenums 61 and upper side plenum 62 are open at their forward ends to allow the exchange of gasses, e.g. air, through the louver doors 46 between the room in which the fireplace is situated and the upper and lower side plenums 61 and 62.

The rearward portion of the divider 63 which extends between the rear sections 14*b* of the housing side panel 14 and the rear sections 22*b* of the firebox side panels 22 comprise a plurality of holes 64 to allow air in the lower side plenum 61 to pass directly into the upper side plenum 62.

The lower side plenum 61 also communicates directly with the bottom plenum 29 and rear plenum 27. Likewise, the bottom plenum 29 communicates directly with the rear plenum 27. In this arrangement, room air passing into the bottom plenum 29 and a portion of the room air passing into the lower side plenums 61 will flow rearwardly into the rear plenum 27.

The rear plenum 27 is divided into an inner rear plenum 66, intermediate rear plenum 67 and outer rear plenum 68 by a generally rectangular duct 69. The inner rear plenum 66 is closed at its upper end, i.e., the inner rear plenum 66 does not communicate directly with the top plenum 26. However, the inner rear plenum 66 does communicate with both the lower and upper side plenums 61 and 62. Air entering the inner rear plenum 66 from the bottom plenum 29 and lower side plenums 62 passes upwardly as it is heated and then laterally outwardly into the upper side plenums 61.

The duct 69 extends across the width of the rear plenum 27, the interior of the duct forming the intermediate rear plenum 67. The duct 69 is open at its lower and upper ends allowing air from the bottom plenum 29 and lower side plenums 62 to enter the duct 69 at its lower end and to exit the duct into the top plenum 26.

The outer rear plenum 68 allows air to circulate around the lower portion of the duct 69 and maintains the temperature of the outer surfaces of the housing wall adjacent the outer rear plenum 68 at an acceptably cool level.

The top plenum 26 receives hot exhaust gasses from the combustion chamber and cooler room air from the intermediate rear plenum 67. The top plenum 26 is in communication with the upper side plenums 61. In this arrangement, hot exhaust gasses from the combustion chamber enter the top plenum 26 mix with cool air from the intermediate rear plenum 67. This mixture then passes into the upper side plenums 61 where it mixes with additional room air further reducing the temperature of the exhaust gasses which then pass out the front of the fireplace through the louver doors 46. In a zero clearance unit, it is presently preferred to reduce the exterior temperature of the top wall of the fireplace housing by including a heat shield panel spaced apart about one inch from the top wall of the housing and forming a chamber above the top wall of the housing. The chamber may be filled with insulation or may be a dead space, i.e. filled only with air.

In the embodiment shown, there is provided a relatively thin opening at the front of the top plenum 26 so that a portion of the mixture of exhaust gasses from the combustion chamber 30 and room air from the intermediate rear plenum 67 may exit the top plenum 26 directly into the room. It should be understood that size of the opening at the front of the top plenum 26 may vary as desired. Moreover, this opening may be eliminated in its entirety so that all of the hot gasses in the top plenum 26 pass into the upper side plenums 61 before exiting the fireplace.

Figure 5:
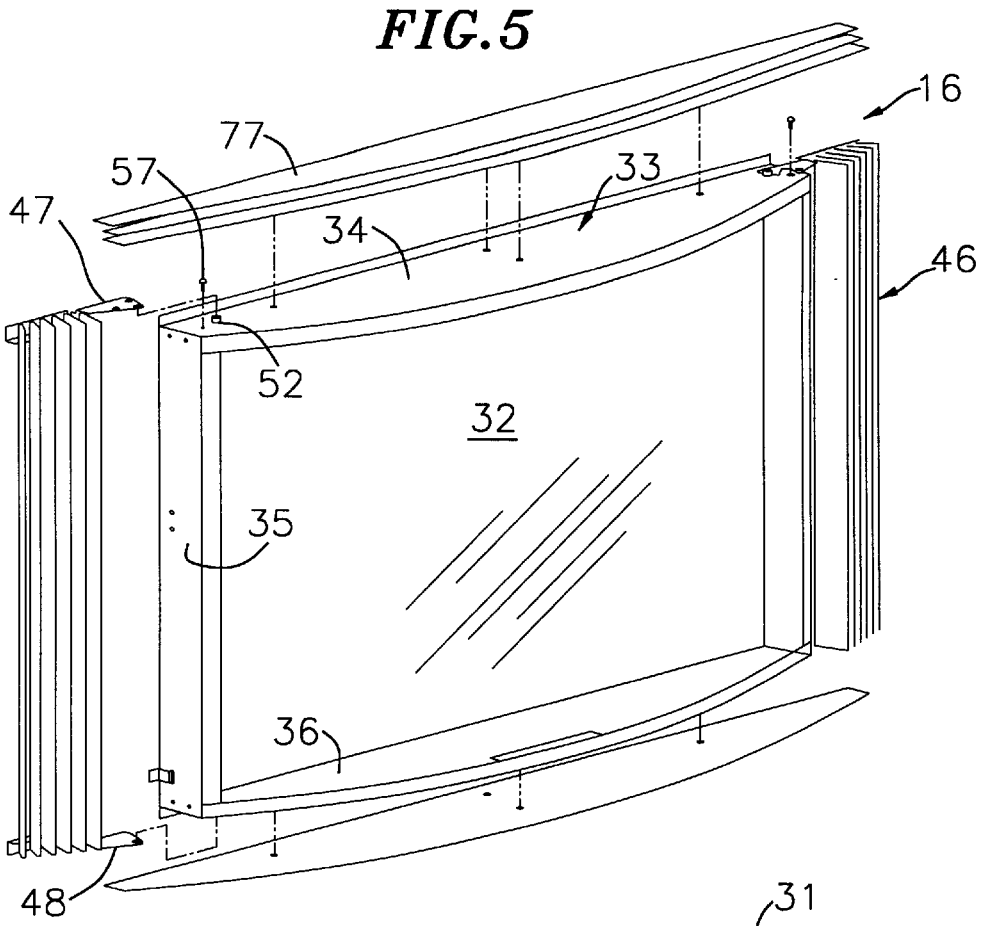
FIG. 5 is an exploded perspective view of a preferred glass panel and door assembly.
Figure 6:
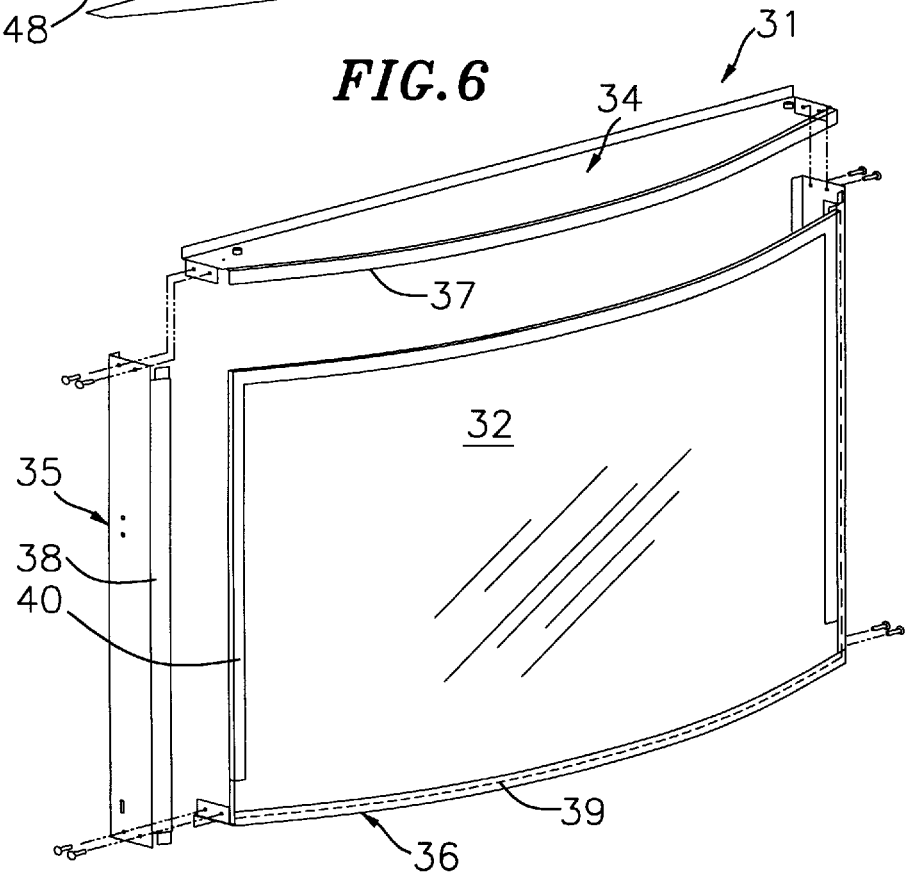
FIG. 6 is an exploded view of the glass panel assembly of the glass panel and door assembly of FIG. 5.

As shown in FIG. 5, a plurality of vertically spaced apart heat dissipating fins 77 are fixedly attached to the top member 34 of the glass frame by bolts 75 and nuts 76 and are maintained in a spaced apart relation by spacers 79. The fins 77 extend across the opening at the front of the top plenum 26. It should be understood that the number of fins, size of openings, method of attachment and the like may vary as desired.

Figure 4:
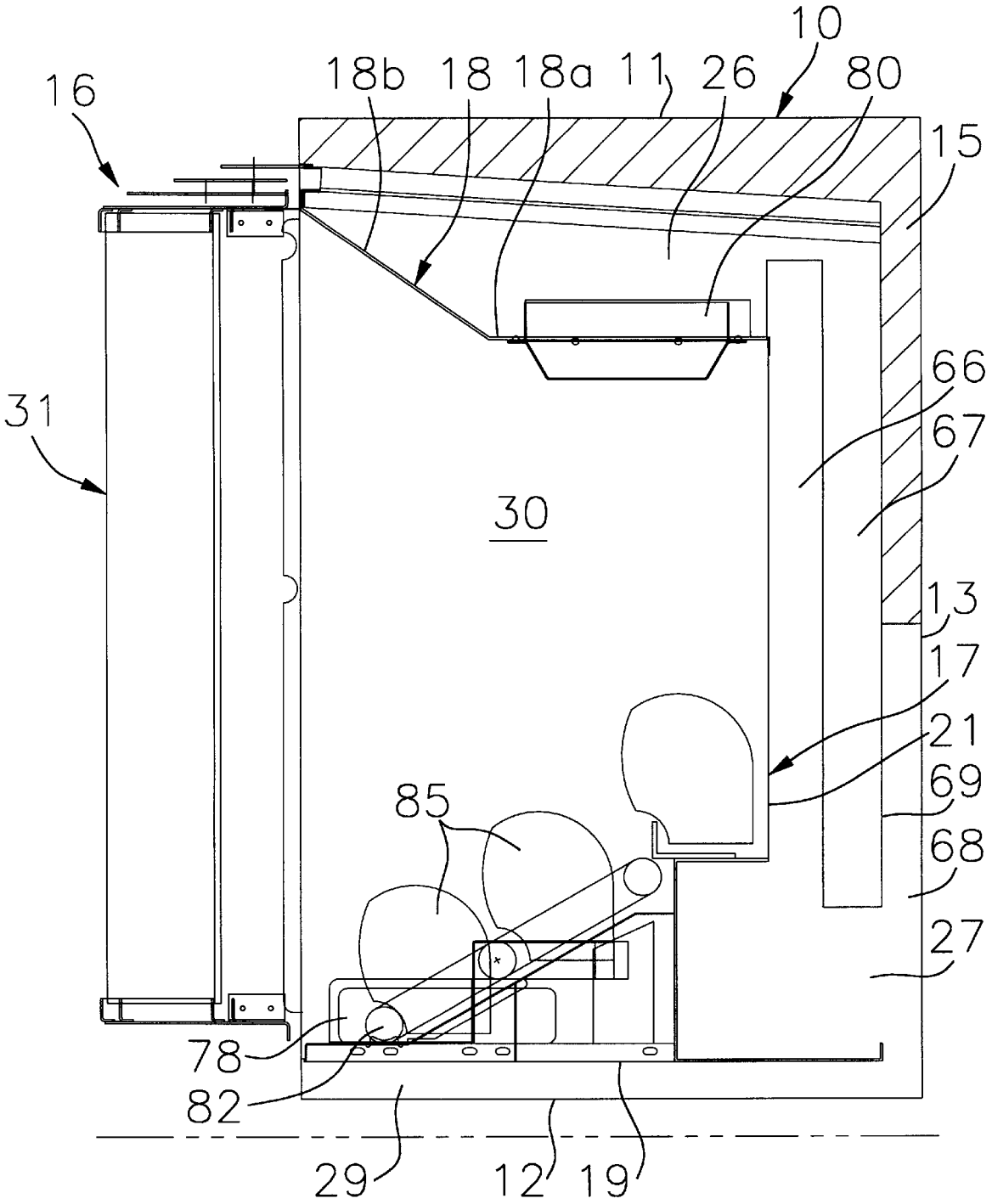
FIG. 4 is a vertical cross-sectional view of the fireplace of FIG. 1.

Referring now to FIGS. 1 and 4, combustion air enters the combustion chamber 30 through intake openings 78 at the bottom of each side panel 22 of the firebox 17. Openings 78 allow combustible room air to pass from the lower side plenum 61 into the combustion chamber 30.

Hot exhaust gasses are formed within the combustion chamber 30 by means of a burner assembly 81. With reference to FIGS. 1 and 4, the burner assembly 81 comprises a burner tube 82 and a burner pan 83. The burner pan 83 comprises steps and brackets for supporting the burner tube 82 and ceramic or other artificial logs 85. In the embodiment shown, the burner tube 82 has laterally extending upper, middle and lower generally parallel tube sections interconnected by a transverse center tube section. One side of the middle laterally extending tube section bends rearwardly extending through the burner pan 83 where it connects to a gas delivery tube (not shown) which extends through the firebox side wall into the lower side plenum 62. Gas is delivered through the gas delivery tube to the burner tube 82 and is combined with air which enters the burner tube 82 through an opening 84 downstream from the connection between the burner tube 82 and gas delivery tube by an adjustable air shutter 86. Each section of the burner tube 82 comprises a plurality of holes or openings through which the gas/air mixture passes for combusting within the fire box.

Gas entering the gas delivery tube and burner tube 82 is controlled by a valve (not shown) located in the left side intake plenum just behind the louver door 46. The valve is controllable by a rotatable knob which can be operated manually. A suitable, commercially available valve is manufactured by S.I.T. Controls Company and is marketed under the trade designation P/N 0,820,638.

The gas/air mixture is ignited in the combustion chamber 30 by means of a pilot as is well known in the art. Preferably the pilot is part of an oxygen depletion sensor assembly. A suitable, commercially available oxygen depletion sensor assembly is manufactured by O.P. of Italy and sold under the trade designation NG Oxygenator/mv O.D.S. No. 8204 for natural gas and LPG Oxygenator/mv O.D.S. No. 8404 for propane gas.

Exhaust gasses pass out of the combustion chamber 30 through a large opening in the rear portion of the top panel 18 of the firebox 17 in which a catalytic converter 80 is positioned.

Figure 13:
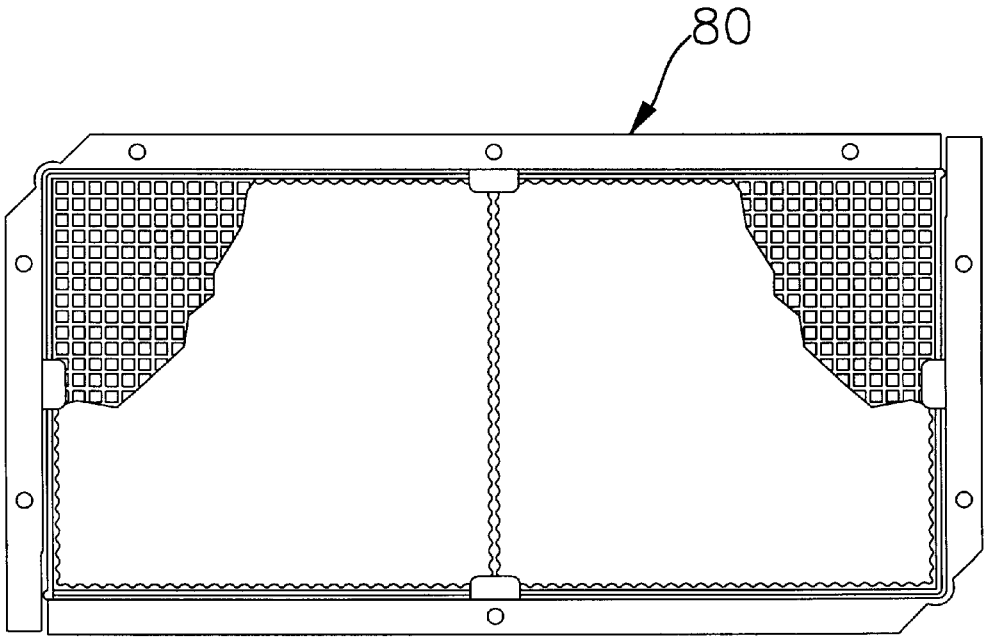
FIG. 13 is a top view of a preferred catalytic converter.

With reference to FIG. 13, the catalytic converter 80 reduces the amount of carbon monoxide and hydrocarbons in the exhaust gasses by catalytically converting them to carbon dioxide and water. It also reduces the amount of nitrogen dioxide ($NO_2$) by converting it to nitrogen oxide (NO). The catalytic material typically comprises a noble metal such as platinum or palladium. If desired, a combination of catalytic materials may be used to improve the conversion of different exhaust compounds. The catalytic converter operates generally within the temperature range of from about 500 to about 1500° F. The physical structure, e.g., size, shape, porosity, surface area, etc., and type of catalyst in the catalytic converter are selected to maintain a suitable flow rate through the catalytic converter while at the same time converting sufficient carbon monoxide and undesirable hydrocarbons to carbon dioxide and water at a selected operating temperature to meet all applicable emission standards.

A presently preferred catalytic converter is manufactured by Corning Incorporated and sold under the trade name Pro-Vac 9"A", P/N 83-1882. With reference to FIG. 13, the catalytic converter 80 is formed into a generally honeycomb-like structure, having an overall rectangular shape of about 5-¼ inches by 5-¼ inches with a thickness of approximately 1 inch. The generally square openings through the catalytic converter are approximately 0.2 inches wide.

To maintain the temperature of the catalytic converter at approximately 600° F. or above, it is necessary to restrict the flow of cool air over the catalytic converter. This is particularly important if the fireplace is a forced air unit comprising a fan to increase the flow of air through the lower and upper side plenums. As described above, this is accomplished by permitting only air flowing through duct 69 in the rear plenum 27 to pass directly into the top plenum 26. The amount of air passing through duct 69 is in turn restricted by its cross-sectional size and/or the size of the opening at the upper end of duct 69.

The presence of the catalytic converter allows the use of a large attractive yellow flame within the combustion chamber which closely simulates the flame of a wood burning fireplace. While such a flame often produces unacceptable high levels of carbon monoxide, such levels are reduced to acceptable levels by the catalytic converter. Current ANSI standards require a carbon monoxide emission level equal to or less than 200 ppm air free, i.e. zero oxygen level, and an $NO_2$ emission of less than 20 ppm air free. By means of the present invention, the amount of carbon monoxide in the gas exiting the fireplace into the room is maintained at preferably no more than about 20 ppm air free and more preferably no more than about 6 ppm air free and the $NO_2$ levels are maintained at less than 10 ppm air free and preferably less than 6 ppm air free. It should be understood that, if tight controls are maintained on the combustion conditions so that unacceptable levels of carbon monoxide, $NO_2$ and hydrocarbons are not produced, the need for a catalytic converter may be eliminated.

The structure and location of the catalytic converter may be varied as desired. For example, rather than a catalytic converter 80 having a honey-combed structure, as shown in FIG. 13, a porous, sponge-like structure may be employed. In such an embodiment, the size, thickness and porosity of the structure would be selected so as not to create excessive back pressure in the system. Alternatively, a fan may be used to pressurize the combustion chamber and force exhaust gasses through a porous catalyst to oxidize products of incomplete combustion. In such an arrangement, the catalyst may be placed anywhere in the exhaust stream.

Figure 14:
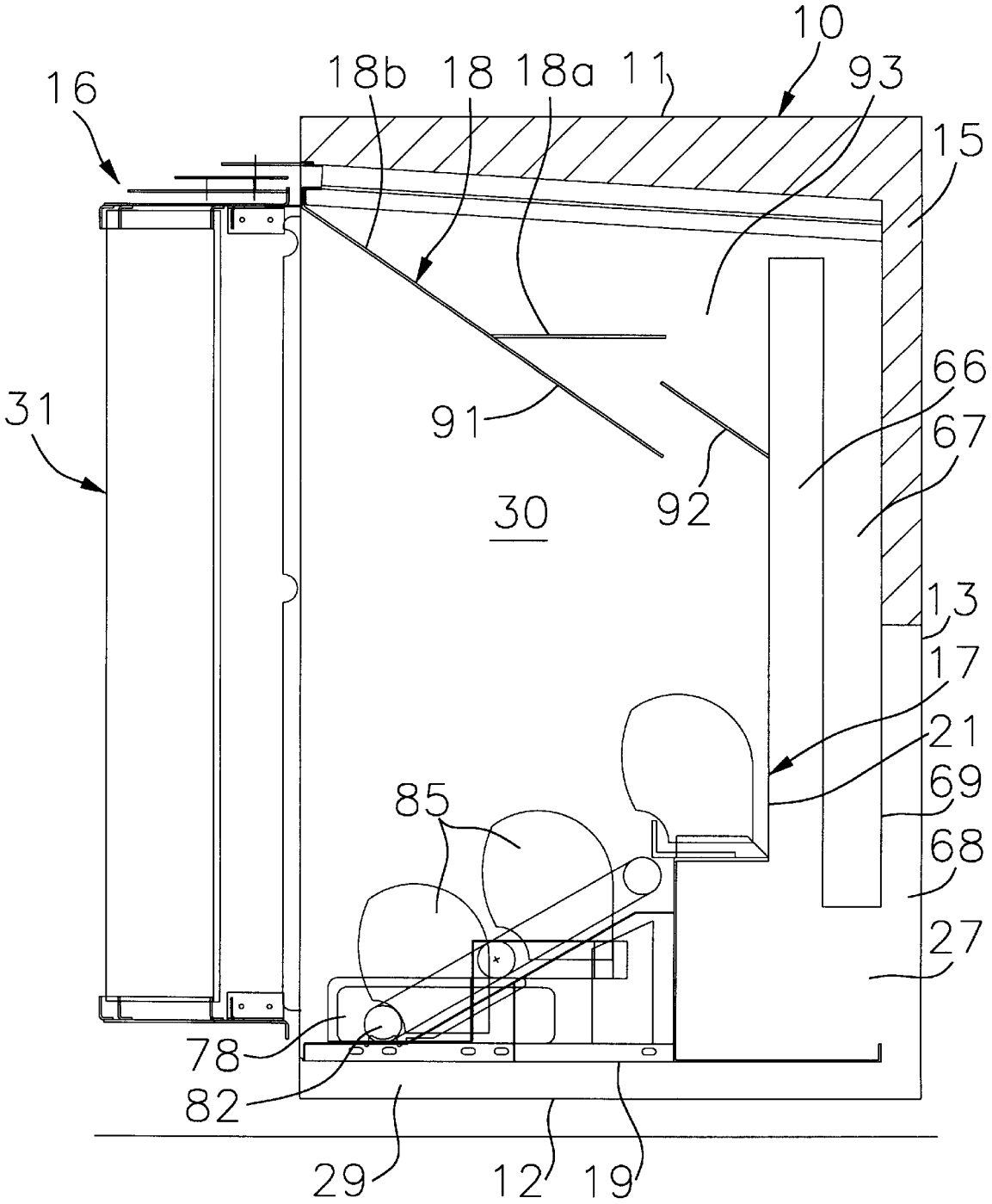
FIG. 14 is a vertical cross-sectional view of another preferred fireplace constructed in accordance with the present invention.

Rather than applying the catalyst to a separate structure, e.g., a honey-comb substrate, the catalyst could be applied to one or more baffles within the combustion chamber and/or the top panel of the fire box. For example, as shown in FIG. 14, there may be provided a pair of overlapping baffles 91 and 92 which directs the hot exhaust gasses formed in the combustion chamber through an opening 53 the top panel 18 of the fire box 17 before exiting the combustion chamber 30. In such an embodiment, the baffles 91 and 96 and top panel 18 of the fire box 17 may be coated with the catalyst so that, as the hot exhaust rises, it contacts these catalytic surfaces allowing carbon monoxide and hydrocarbons in the exhaust to react and form carbon dioxide and water. Coating of the baffles and top panel may be accomplished for example by depositing noble metals on the surface.

It is understood that the fireplace may comprise additional features and accessories. For example, the fireplace preferably comprises a carbon monoxide sensor which, if present, is preferably located, for example, in a lower side plenum for easy access. The fireplace may comprise interior panels or liners to provide the side and rear walls of the firebox with a porcelain or brick pattern. Forced air blowers, preferably variable speed forced air blowers, may be provided to control the amount of air flowing through the plenums. The positioning of both an intake air plenum, i.e., lower side plenum and exhaust plenum, i.e., upper side plenum, adjacent each side of the fire box enables the construction of a fireplace with increased height of the glass panel. That is, by locating the gas valve and other accessories, e.g., carbon monoxide sensor, in the lower side plenums, and by minimizing or even eliminating the bottom plenum and minimizing or eliminating the presence of a vent above the glass panel at the front of the fireplace, the height of the viewing area, i.e. the portion of the glass panel through which one can see into the combustion chamber, can be increased to up to at least about 80%, preferably about 85%, and more preferably about 90% of the height of the fireplace when the fireplace is of conventional size, i.e., preferably having a height of less than about 60 inches and more preferably about 48 inches or smaller. By "height of the fireplace," what is meant is the distance from the bottom surface of the bottom panel of the housing to the top surface of the top panel of the housing. The "height of the fireplace" as used herein does not include any feet or spacers above or below the housing top or bottom panels.

Figure 15:
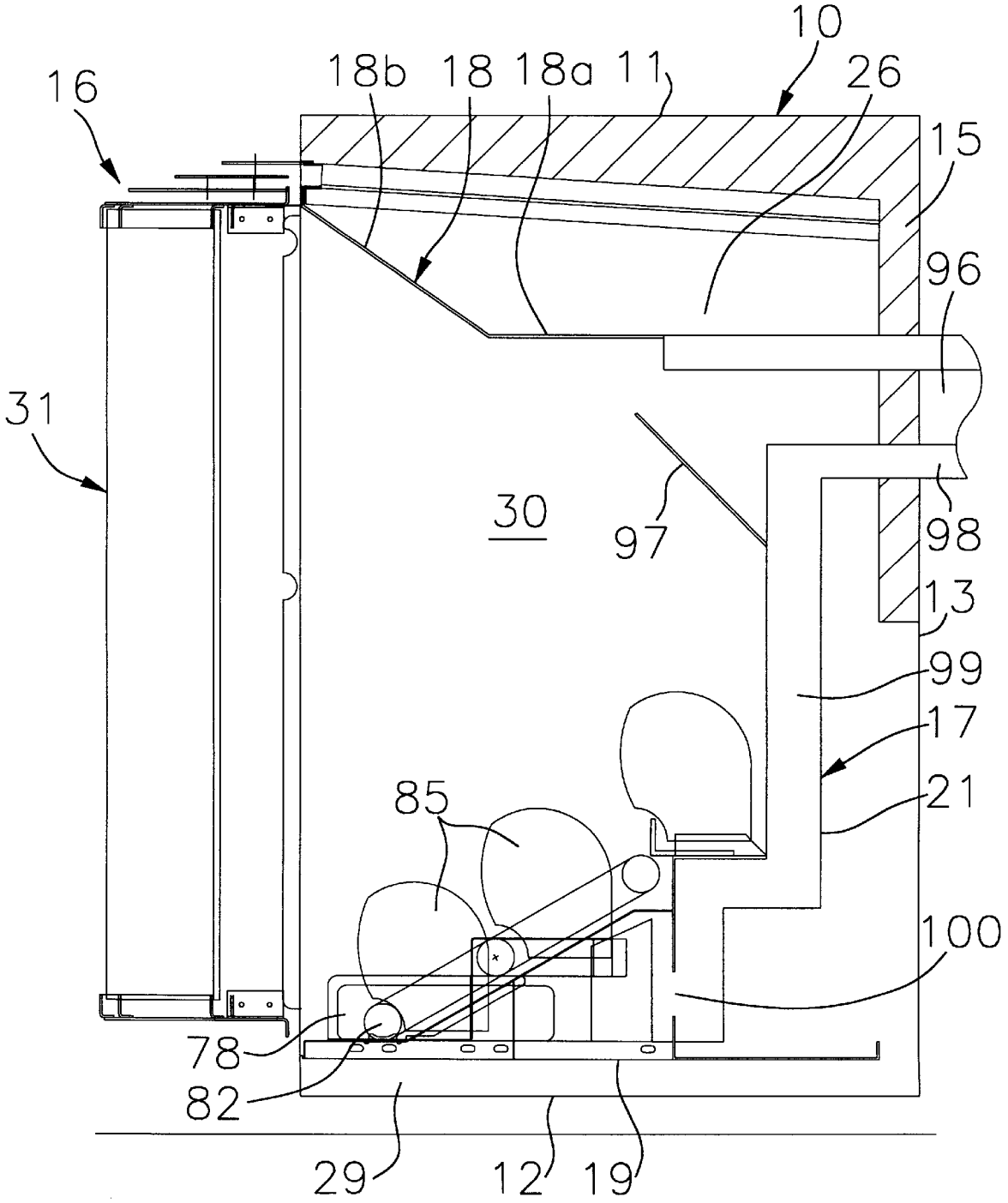
FIG. 15 is a vertical cross-sectional view of yet another preferred fireplace constructed in accorance with the present invention.

Another preferred embodiment of the invention is shown in FIG. 15. In this embodiment, the fireplace is a rear direct vent fireplace in which exhaust from the combustion chamber 30 is vented through an exhaust vent 96 which extends through an exterior wall of the house or building in which the fireplace is situated directly to the outside atmosphere. One or more baffles or the like, e.g., baffle 97 may be present within the combustion chamber to increase the residence time of the hot combustion gasses within the combustion chamber 30 to thereby increase the heat transfer through the firebox panels to the room air passing through plenums adjacent the firebox.

Combustion air is drawn from the outside atmosphere through intake vent 98 and combustion air plenum 99, entering the combustion chamber through openings 100.

The foregoing description has been presented with respect to the preferred embodiments shown in the accompanying drawings. It will be appreciated by those skilled in the art that many other modifications of the structures shown including size, shape and arrangement, may be made without departing from the meaning and scope of the invention.

For example, it is apparent that, if desired, exhaust formed in the combustion chamber could be vented through the top wall in a manner consistent with conventional top vent units. It is equally apparent that the fireplace need not be restricted to a single glass panel. Clearly two or more glass panels could be employed in a see-through, a corner, or a "peninsula" arrangement.

Alternatively, a glass panel need not be present at all. In such an arrangement, the flame would not be visible and the aesthetics of the flame would be unimportant. This would allow the use of a cleaner burning blue flame, thereby allowing the use of a smaller catalytic converter to clean the exhaust.

Accordingly, the present invention is not meant to be limited to the particular embodiments described above. Rather, the scope of the invention is meant to be defined by the following claims which are to be given their broadest fair scope.

What is claimed is:

1. A gas fireplace comprising:

a housing comprising top, bottom, rear and side walls;

a firebox within the housing having a top panel, a bottom panel, two side panels and a rear panel;

a glass panel at the front of the firebox which, in combination with the firebox, forms a combustion chamber;

a burner in the combustion chamber for facilitating the combustion of gas generating combustion gasses;

a side air plenum between each side wall of the housing and each side panel of the firebox, each side air plenum having an upper portion and a lower portion;

an opening at the front of the upper portion of each side plenum and at the front of the lower portion of each lower side plenum;

at least one opening in the lower portion of at least one firebox side panel or rear panel for allowing air to pass into the combustion chamber;

means for exhausting hot combustion gasses from the combustion chamber into the upper portions of the side plenums.

2. A gas fireplace as claimed in claim 1 further comprising a rear plenum exterior to the rear panel of the firebox in communication with the lower and upper portions of the side plenums.

3. A gas fireplace as claimed in claim 1 wherein the means for exhausting hot combustion gasses from the combustion chamber into the upper portions of the side plenums comprises a top plenum above the top panel of the firebox in communication with the upper portions of the side plenums and an opening in the top panel of the firebox for exhausting hot combustion gasses from the combustion chamber into the top plenum.

4. A gas fireplace as claimed in claim 1 wherein the means for exhausting hot combustion gasses from the combustion chamber into the upper portions of the side plenums comprises at least one opening between the combustion chamber and the upper portion of each firebox side panel.

5. A gas fireplace as claimed in claim 1 comprising a horizontal divider between the upper portion of the side plenum and the lower portion of the side plenum for dividing each side plenum into an upper side plenum and a lower side plenum.

6. A gas fireplace as claimed in claim 5 wherein each divider separating an upper side plenum from a lower side plenum has at least one opening for allowing air in the lower side plenum to pass directly into the upper side plenum.

7. A gas fireplace as claimed in claim 1 further comprising a catalytic converter comprising a catalyst positioned so that at least a portion of the exhaust gasses from the combustion chamber will contact the catalyst before exiting the fireplace.

8. A gas fireplace as claimed in claim 7 wherein the catalytic converter comprises at least one opening and is positioned so that hot combustion gasses from the combustion chamber pass through the opening of the catalytic converter as such gasses exit the combustion chamber.

9. A gas fireplace as claimed in claim 1 wherein the glass panel is non-planer.

10. A gas fireplace as claimed in claim 1 wherein the glass panel is planer.

11. A gas fireplace as claimed in claim 1 wherein the glass panel comprises at least 2 generally flat sections.

12. A gas fireplace as claimed in claim 1 further comprising a vent door adjacent each lateral edge of the glass panel, each of said vent doors being movable between open and closed positions.

13. A vent-free gas fireplace comprising:

a housing comprising a top wall, a bottom wall, a pair of side walls and a rear wall;

a firebox within the housing having a top panel, a bottom panel, two side panels and a rear panel;

a glass panel at the front of the firebox which, in combination with the firebox, forms a combustion chamber;

a burner in the combustion chamber for facilitating the combustion of gas generating combustion gasses;

a side air plenum formed within the housing exterior to each side panel of the firebox, each side air plenum having an upper portion and a lower portion;

an opening at the front of the upper portion of each side plenum and at the front of the lower portion of each lower side plenum;

at least one opening in the lower portion of at least one firebox side panel or rear panel for allowing air to pass into the combustion chamber;

means for exhausting hot combustion gasses from the combustion chamber into the upper portions of the side plenums, wherein at least a portion of the combustion gases are vented into a room in which the fireplace is located.

14. A vent-free gas fireplace as claimed in claim 13 further comprising a rear plenum exterior to the rear panel of the firebox in communication with the lower portions of the side plenums and the upper portions of the side plenums.

15. A vent-free gas fireplace as claimed in claim 13 wherein the means for exhausting hot combustion gasses from the combustion chamber into the upper portions of the side plenums comprises a top plenum above the top panel of the firebox in communication with the upper portions of the side plenums and an opening in the top panel of the firebox for exhausting hot combustion gasses from the combustion chamber into the top plenum.

16. A vent-free gas fireplace as claimed in claim 13 wherein the means for exhausting hot combustion gasses from the combustion chamber into the upper portions of the side plenums comprises at least one opening between the combustion chamber and the upper portion of each firebox side panel.

17. A vent-free gas fireplace as claimed in claim 13 comprising a horizontal divider between the upper portion of the side plenum and the lower portion of the side plenum for dividing each side plenum into an upper side plenum and a lower side plenum.

18. A vent-free gas fireplace as claimed in claim 17 wherein each divider separating an upper side plenum from a lower side plenum has at least one opening for allowing air in the lower side plenum to pass directly into the upper side plenum.

19. A vent-free gas fireplace as claimed in claim 13 farther comprising a catalytic converter positioned so that at least a portion of the exhaust gasses from the combustion chamber will contact the catalyst of the catalytic converter before exiting the fireplace.

20. A vent-free gas fireplace as claimed in claim 19 wherein the catalytic converter comprises at least one opening and is positioned so that hot combustion gasses from the combustion chamber pass through the opening of the catalytic converter as such gasses exit the combustion chamber.

21. A vent-free gas fireplace as claimed in claim 13 wherein the glass panel is non-planer.

22. A vent-free gas fireplace as claimed in claim 13 wherein the glass panel is planer.

23. A vent-free gas fireplace as claimed in claim 13 wherein the glass panel comprises at least 2 generally flat sections.

24. A vent-free gas fireplace as claimed in claim 13 further comprising a vent door adjacent each lateral edge of the glass panel, each of said vent doors being movable between open and closed positions.

25. A gas fireplace comprising:

a housing having a rear and a pair of side walls;

a firebox within the housing having a pair of side panels;

a combustion chamber within the firebox;

a burner in the combustion chamber for facilitating the combustion of gas generating exhaust gasses;

a side plenum between each side panel of the firebox and the adjacent side wall of the housing, wherein the side plenum is divided into an upper side plenum and a lower side plenum;

an opening through which room air can enter the side plenum; and at least one opening in the side panel of the firebox through which air can pass from the side plenum into the combustion chamber, wherein the upper side plenum receives hot exhaust gasses generated in the combustion chamber.

26. A gas fireplace as claimed in claim 25 wherein the upper side plenum further receives room air from the lower side plenum.

27. A gas fireplace comprising:

a housing having a rear and a pair of side walls;

a firebox within the housing having a pair of side panels;

a combustion chamber within the firebox;

a burner in the combustion chamber for facilitating the combustion of gas generating exhaust gasses;

a side plenum between each side panel of the firebox and the adjacent side wall of the housing, wherein the side plenum is divided into an upper side plenum and a lower side plenum;

an opening through which room air can enter the side plenum; and at least one opening in the side panel of the firebox through which air can pass from the side plenum into the combustion chamber, wherein the upper side plenum receives hot exhaust gasses generated in the combustion chamber, and wherein a portion of the exhaust gases are vented into a room in which the fireplace is located.

28. A gas fireplace comprising:

a housing having a rear and a pair of side walls;

a firebox within the housing said firebox having a rear panel and a pair of side panels, each side panel being spaced apart from the side walls of the housing;

a burner in the firebox for facilitating the combustion of gas generating combustion products;

a side plenum between the side panels of the firebox and the side walls of the housing;

means for dividing each side plenum into an upper side plenum and a lower side plenum;

an opening at the front of each lower side plenum through which room air may pass into the lower side plenum;

an opening at the front of each upper side plenum through which heated air may pass out of the upper side plenum;

means for enabling air in the lower side plenum to pass into the upper side plenum; and means for directing at least a portion of the combustion products produced in the firebox into the upper portion of the side plenums.

29. A gas fireplace as claimed in claim 28 wherein the means for dividing each side plenum comprises a generally horizontal divider between the upper side plenum and the lower side plenum.

30. A gas fireplace as claimed in claim 29 wherein the means for enabling air in the lower side plenum to pass into the upper side plenum comprises at least one opening in the generally horizontal divider.

31. A gas fireplace as claimed in claim 29 wherein the means for enabling air in the lower side plenum to pass into the upper side plenum comprises a rear plenum between the rear panel of the firebox and the rear wall of the housing, said rear plenum being in communication with each of the upper and lower side plenums.

32. A gas fireplace as claimed in claim 28 wherein wherein a portion of the combustion gases produced in the combustion chamber are vented into a room in which the fireplace is located.

33. A gas fireplace comprising:

a housing having top, bottom, rear and side walls;

a firebox within the housing having top, bottom, rear and side panels;

a burner in the firebox for facilitating the combustion of gas generating combustion gasses;

a top plenum between the top wall of the housing and the top panel of the firebox;

a side plenum between each side wall of the housing and each side panel of the firebox;

a rear plenum between the rear wall of the housing and the rear panel of the firebox, said rear plenum being in communication with the side plenums and the top plenum; and means for restricting the flow of air from the rear plenum into the top plenum, said means dividing the rear plenum into at least two smaller plenums and blocking the flow through at least one of the smaller plenums.

34. A gas fireplace as claimed in claim 33 wherein the means for restricting the flow of air from the rear plenum into the top plenum comprises:

means for dividing the rear plenum into an inner rear plenum adjacent the firebox and an outer rear plenum between the inner rear plenum and the rear wall of the housing and means for preventing air in one of the inner rear plenums and outer rear plenums from passing directly into the top plenum.

35. A gas fireplace as claimed in claim 33 wherein a portion of the combustion gases produced in the firebox are vented into a room in which the fireplace is located.

36. A gas fireplace as claimed in claim 35 wherein the means for restricting the flow of air from the rear plenum into the top plenum comprises:

means for dividing the rear plenum into an inner rear plenum adjacent the firebox and an outer rear plenum between the inner rear plenum and the rear wall of the housing and means for preventing air in one of the inner rear plenums and outer rear plenums from passing directly into the top plenum.

37. A gas fireplace as claimed in claim 35 further comprising a catalytic converter situated so that at least a portion of the exhaust gasses from the combustion chamber contact the catalyst of the catalytic converter before exiting the fireplace.

38. A gas fireplace comprising:

a housing having top, bottom, rear and side walls;

a firebox within the housing having top, bottom, rear and side panels;

a burner in the firebox for facilitating the combustion of gas generating combustion gasses;

a side plenum between each side wall of the housing and each side panel of the firebox;

an opening at the front of each side plenum through which heated gasses may pass out of the fireplace;

a top plenum between the top wall of the housing and the top panel of the firebox, said top plenum being in communication with the side plenums;

an opening in the top panel of the firebox;

a catalytic converter mounted in the opening in the top panel of the firebox so that hot combustion gasses generated in the firebox pass through the catalytic converter into the top plenum; and means for directing at least a portion of hot gasses in the top plenum into the side plenums and out of the fireplace.

39. A gas fireplace as claimed in claim 38 further comprising a rear plenum between the rear wall of the housing and the rear panel of the firebox, said rear plenum being in communication with the top plenum.

40. A gas fireplace as claimed in claim 39 further comprising means for restricting the flow of air from the rear plenum into the top plenum.

41. A gas fireplace as claimed in claim 38 wherein a portion of the combustion gases generated in the firebox are vented into a room in which the fireplace is located.

42. A gas fireplace as claimed in claim 41 further comprising a rear plenum between the rear wall of the housing and the rear panel of the firebox, said rear plenum being in communication with the top plenum.

43. A gas fireplace as claimed in claim 42 further comprising means for restricting the flow of air from the rear plenum into the top plenum.

44. A gas fireplace comprising:

a housing having a pair of side walls, and a front wall comprising a glass panel, said glass panel having lateral edges;

a firebox within the housing having a pair of side walls, said firebox and glass panel forming a combustion chamber;

a burner in the combustion chamber for facilitating the combustion of gas generating combustion gasses;

a side plenum between each firebox side panel and housing side wall; and a vent door adjacent each lateral edge of the glass panel, each of said vent doors being movable between open and closed positions where in their open positions, the vent doors provide access by an operator into the side plenums and in their closed positions, the vent doors block access by an operator to the side plenums.

45. A gas fireplace as claimed in claim 44 wherein a portion of the combustion gases generated in the combustion chamber are vented into a room in which the fireplace is located.

46. A gas fireplace comprising:

a firebox having a top panel, a bottom panel, two side panels and a rear panel;

a glass panel at the front of the firebox which, in combination with the firebox, forms a combustion chamber;

a burner in the combustion chamber for facilitating the combustion of gas generating combustion gasses;

a side air plenum exterior to each side panel of the firebox, each side air plenum having an upper portion and a lower portion;

an opening at the front of the upper portion of each side plenum and at the front of the lower portion of each lower side plenum;

at least one opening in the lower portion of at least one firebox side panel or rear panel for allowing air to pass into the combustion chamber;

means for exhausting hot combustion gasses from the combustion chamber into the upper portions of the side plenums.

* * * * *